US008910404B2

(12) United States Patent
Ruybal

(10) Patent No.: US 8,910,404 B2
(45) Date of Patent: Dec. 16, 2014

(54) FLAT STOCK DEVICE TO ATTACH A PRINTED DISPLAY AND A FLAG THEREWITH TO A FENCE

(71) Applicant: James Ruybal, Layton, UT (US)

(72) Inventor: James Ruybal, Layton, UT (US)

( * ) Notice: Subject to any disclaimer, the term of this patent is extended or adjusted under 35 U.S.C. 154(b) by 0 days.

(21) Appl. No.: 14/184,583

(22) Filed: Feb. 19, 2014

(65) Prior Publication Data

US 2014/0165436 A1 Jun. 19, 2014

(51) Int. Cl.

| | |
|---|---|
| ***G09F 15/00*** | (2006.01) |
| ***G09F 7/18*** | (2006.01) |
| ***G09F 17/00*** | (2006.01) |

(52) U.S. Cl.

CPC . *G09F 7/18* (2013.01); *G09F 17/00* (2013.01)
USPC ..... 40/606.03; 40/606.16; 116/173

(58) Field of Classification Search

USPC ..... 40/606.03, 606.01, 606.16, 606.13; 116/173
See application file for complete search history.

(56) References Cited

U.S. PATENT DOCUMENTS

| | | | | |
|---|---|---|---|---|
| 3,219,010 | A * | 11/1965 | Hyatt | 116/173 |
| 4,233,769 | A * | 11/1980 | Archer | 40/607.12 |
| 4,960,067 | A * | 10/1990 | Currie | 116/28 R |
| 6,742,757 | B2 | 6/2004 | Fox | |
| 6,857,614 | B2 | 2/2005 | Fox | |
| 6,964,403 | B2 | 11/2005 | Fox | |
| 7,631,763 | B1 * | 12/2009 | Brown | 206/527 |
| 7,743,725 | B2 | 6/2010 | Kengerski | |
| 2011/0056103 | A1 * | 3/2011 | Giampavolo | 40/606.03 |

* cited by examiner

*Primary Examiner* — Gary Hoge
(74) *Attorney, Agent, or Firm* — Lyman Moulton, Esq.; Moulton Patent PLLC

(57) ABSTRACT

A device, system and method are configured to attach a printed display and a flag therewith to a fence, rail and the like. The disclosure includes a flat stock substrate defining a point of insertion for a free-end of a mast of the flag. Two cutout arms form an I beam cross-section with the substrate and extend backward from the substrate by twisting and hang perpendicularly on a top rail or a side of the fence, the cutout arms each configured at an elbow thereof to wrap around a portion of the fence and down over a side thereof. Two cutout legs extend backward from the substrate by twisting in an upward arc perpendicular to the fence rail and join with the mast through an end of each leg triangulated between the extended cutout arms. Multiple substrates and printed displays may be ganged on a single mast.

20 Claims, 10 Drawing Sheets

FLAT STOCK DEVICE TO ATTACH A PRINTED DISPLAY AND A FLAG THEREWITH TO A FENCE

BACKGROUND AND FIELD OF INVENTION

Signage during political campaign seasons, dot the American landscape. Pickets are placed on residential lawns and fence balustrades are covered with candidates' shingles and messages. Similarly, advertisers sometimes to want the shock value of additional signage during promotionals, sales and liquidations. However, commercial and local city laws and residential covenants and restrictions limit where signs may be placed at a business or on a homeowner's lawn.

While two-dimensional signage is helpful in getting a message across, three-dimensional advertisements provide another way of grabbing attention. Flags and or banners thus posted during political campaigns next to posters and placards help get the voter's attention. On the commercial side, billboards and signage including three-dimensional aspects or components are also effective in getting a consumer's attention. However, flags or banners require extra footprint on the political landscape or the commercially available space.

Furthermore, economies of scale are not favorable for three-dimensional signage due to transportation and manufacturing costs. Flat stock displays transport most easily because of the high density packaging. Also, flat stock displays are economically printed in large numbers. Three-dimensional signage on the other hand, lacks all the economies of two-dimensional signage but is more effective where cost and available advertising space is less an issue.

Flags or banners may be attached to signage with extra and discrete adapters but add cost to the complete advertising system not only in materials but also in installation and maintenance costs and assembly requirements. Integrating the cost and space benefits or two-dimensional signage with the advertising benefits of three-dimensional advertising thus comes at a price premium.

There is therefore a long felt for an integrated flat stock system which produces the effective advertising benefits of three dimensional systems having the production, installation costs and space benefits of two dimensional signage systems.

SUMMARY OF THE INVENTION

A device configured to attach a printed display and a flag therewith to a fence, rail or barrier and the like is disclosed. The device includes a flat stock substrate defining a point of insertion for a free-end of a mast of the flag near an upper edge thereof in relation to viewing the display. The device also includes two to cutout arms configured to extend from the flat stock substrate and hang perpendicularly on a side portion of the fence or a top rail of the fence, the cutout arms each configured at an elbow thereof to wrap around the side portion of the fence or a top of the rail and down over a side thereof. The device further includes at least one cutout leg configured to extend from the flat stock substrate in an upward arc perpendicular to the fence rail and join with the free end of the flag mast through an end of each extended leg between the extended cutout arms. In a two legged configuration, the extended legs extend from the flat stock substrate in an upward arc perpendicular to the fence rail and join with the free end of the flag mast through an end of each extended leg triangulated between the extended cutout arms.

A system configured to attach a printed display and a flag therewith to a fence, rail or barrier and the like, is also disclosed. The disclosed system comprises a resilient low durometer flat stock substrate defining a point of insertion for a free-end of a mast of the flag near an upper edge thereof in relation to viewing the display. The system also includes two cutout arms configured to extend from the flat stock substrate and hang perpendicularly on a top rail of the fence, the cutout arms each configured at an elbow thereof to wrap around a top of the rail and down over a side thereof. The system additionally includes two cutout legs configured to extend from the flat stock substrate in an upward arc perpendicular to the fence rail and join with a free end of the flag mast through an end of each extended leg triangulated between the extended cutout arms. The system further includes a flag or an accessory attached to a mast or rigid member at a first end thereof and a second end of the mast comprising the free-end, the flag mast or rigid member configured to be inserted through the flat stock substrate over the fence rail and into the extended cutout leg ends.

A method for attaching a printed display and a flag therewith to a fence, rail or barrier and the like, is further disclosed. The method includes twisting each of two cutout arms to extend from a flat stock substrate and hang perpendicularly on a top rail of the fence, the cutout arms each configured at an elbow thereof to wrap around a top of the rail and down over a side thereof. The method also includes twisting each of two cutout legs to extend from the flat stock substrate in an upward arc perpendicular to the fence rail and join with a free-end to of a mast of the flag through an end of each twisted leg triangulated between the twisted cutout arms. The method further includes inserting the free-end of the flag mast through the flat stock substrate over the fence rail and into the twisted cutout leg ends, the point of insertion of the flag mast defined in the flat stock substrate near an upper edge thereof.

Other aspects and advantages of embodiments of the disclosure will become apparent from the following detailed description, taken in conjunction with the accompanying drawings, illustrated by way of example of the principles of the disclosure.

Figure 1:
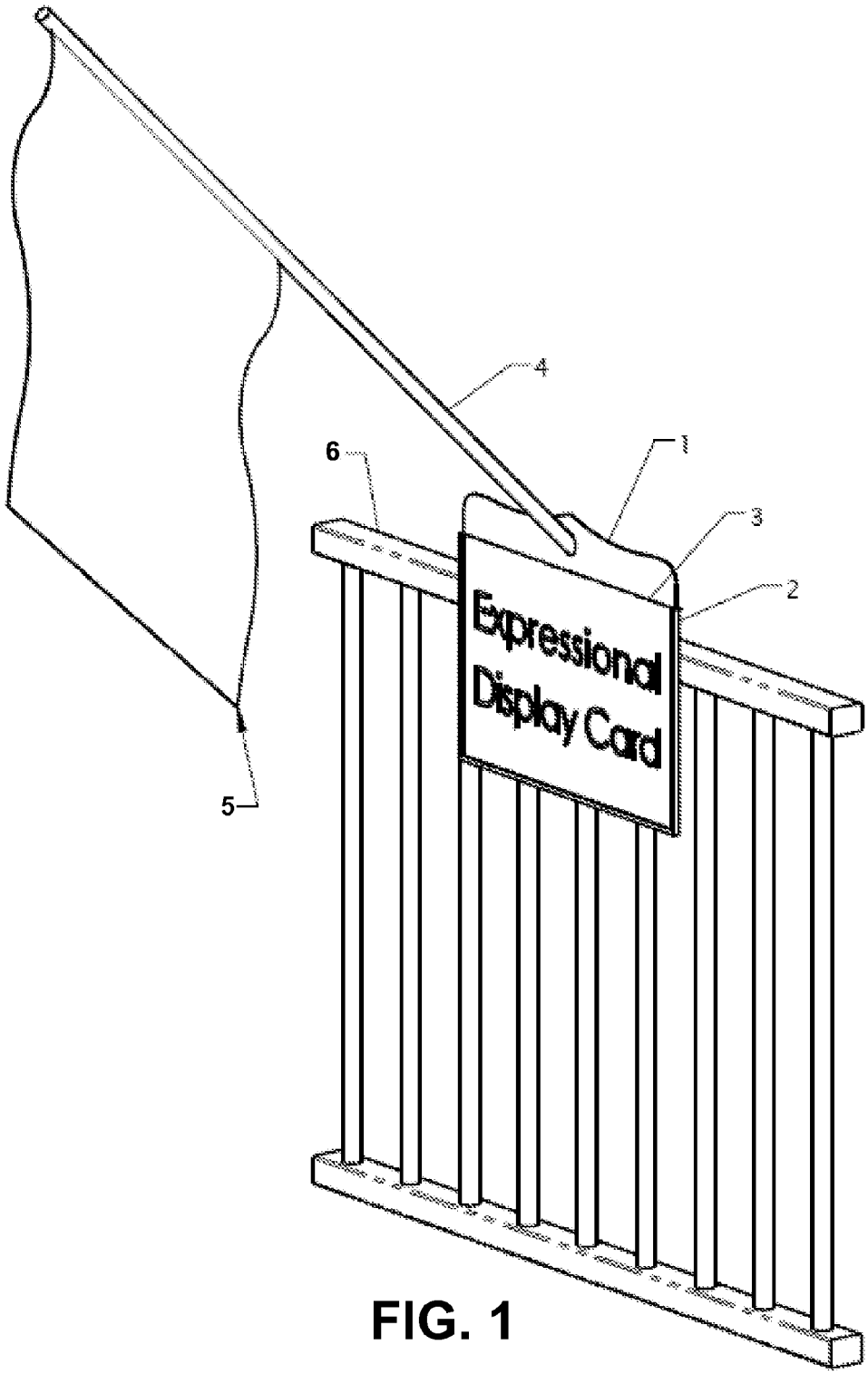
FIG. 1 is a front-side perspective view of an assembled system configured to attach a printed display and a flag therewith to a fence, rail or barrier and the like in accordance with an embodiment of the present disclosure.

Throughout the description, similar and same reference numbers may be used to identify similar and same elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The term 'flat stock' as used throughout the present disclosure defines a flat medium comprising plastic, paper and wood cardstock, aluminum, tin and other metals and polymers and composites thereof. The term 'web' is borrowed from I beam technology and refers to the weight bearing portion of the beam between the flanges. Therefore, the web height of an arm or a leg component of the flat stock substrate is designed according to mechanical engineering principles similar to I beam design to bear most effectively the weight of the disclosed device and system based on the arms hanging perpendicularly on the fence rail. The term, 'cutout' refers to arm and leg components which are marked, stamped, precut, perforated and otherwise separated for extending from the flat stock substrate by a pulling, pushing, twisting or any other digital or mechanical action. The extended arms and legs therefore remain attached at one end to the flat stock substrate and derive support therefrom similar in the way that a paper doll's arms and legs are cutout from a flat cardstock but remain attached to the body. Additionally, all dimensions specified herein include a plus or minus ten percent tolerance for manufacturing and vendor interchangeability. The terms 'mast' and 'flag' are not to be limited to traditional national and state flags but may also include banners hung on a supporting structure(s) and decorations suspended from rigid members such as a Valentine's heart shaped decoration with a rigid wire or wooden supporting member, etc. Furthermore, the term 'rail,' may refer to the portion of the fence or barrier comprising one of a top, bottom and side rail, a horizontal member and any angular member with respect to a fence post and barrier column thereof, the members comprising chain link fence wires, pipes, wooden and plastic slats and concrete and plaster balustrades, posts and side panels. Therefore, the arms of the disclosed device may interleave a chain link fencing and hang thereon in addition to hanging on the top railing thereof.

FIG. 1 is a front-side perspective view of an assembled system configured to attach a printed display and a flag therewith to a fence, rail or barrier and the like in accordance with an embodiment of the present disclosure. The disclosed system includes a resilient low durometer flat stock substrate 1 defining a point of insertion for a free-end of a mast 4 of a flag 5 near an upper edge of the substrate in relation to viewing the display 3. The flat stock substrate 1 comprises a resilient low durometer material suitable for bending without folding, creasing, tearing or ripping. The disclosed system also includes a receiver channel 2 and an expressional display card 3 which are hung via the developed flat stock substrate 1 on the fence rail 6. The fence balustrade or fence slats or dowels indirectly support the disclosed device by preventing a torque moment of the flag mast 4 about the fence rail 6. However, the fence may also comprise a chain link support and any other support of a fence rail as further explained below. The expressional printed display card 3 may also comprise flat stock receivable into the channel 2 at a bottom and two sides thereof. Therefore, the printed display card 3 may also include 3 dimensional components between the channel 2 edges.

Figure 2:
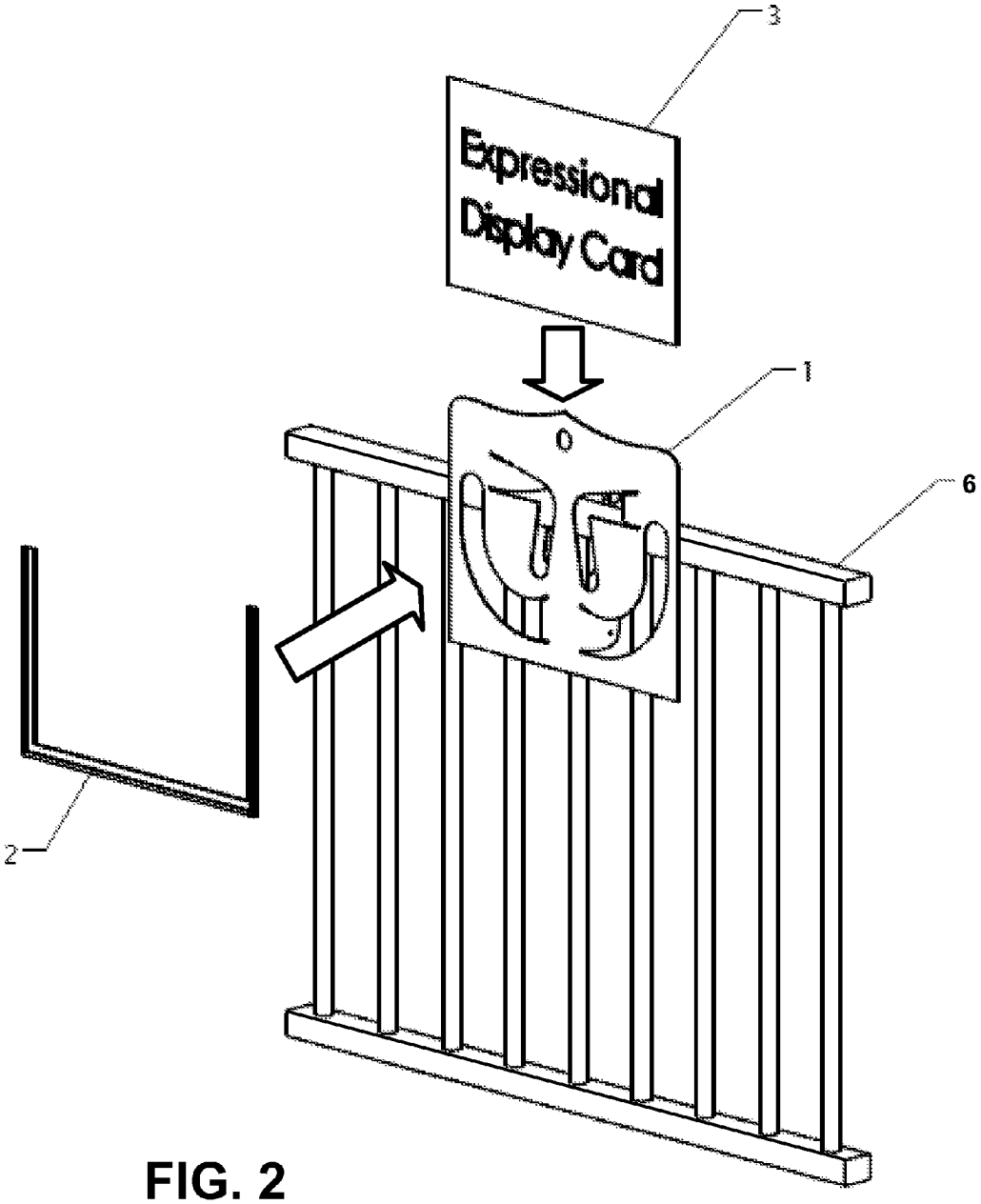
FIG. 2 is an exploded perspective view of a system configured to attach a printed display and a flag therewith to a fence, rail or barrier and the like in accordance with a disclosed embodiment.

FIG. 2 is an exploded perspective view of a system configured to attach a printed display and a flag therewith to a fence, rail or barrier and the like in accordance with a disclosed embodiment. The depicted system shows a resilient low durometer flat stock substrate 1 hanging on the fence rail 6 through components twisted therefrom as explained below. The disclosed system also includes a receiver channel 2 and an expressional display card 3 which are hung via the developed flat stock substrate 1 on the fence rail 6. The expressional printed display card 3 may also comprise flat stock receivable into the channel 2 at a bottom and two sides thereof. The channel is comprised of any rigid material such as wood, metal, or plastic or composites thereof. The printed display card 3 may also include 3 dimensional components between the channel 2 edges. The three sided channel 2 allows the display card 3 to be inserted and removed at any time though a four sided channel (not depicted) may also be included for flexible display stock which may be inserted and removed therefrom at any time. Also, the flat stock substrate 1 may also comprise non-resilient flat stock such as metal and paper card stock and cardboard and composites thereof. As explained and understood below, resilient flat stock 1 allows twisting of component pieces from the substrate without creasing and bending and therefore provides not only reusability of the substrate but also provides maximum torsional strength for hanging the display and the flag accessory.

Figure 3:
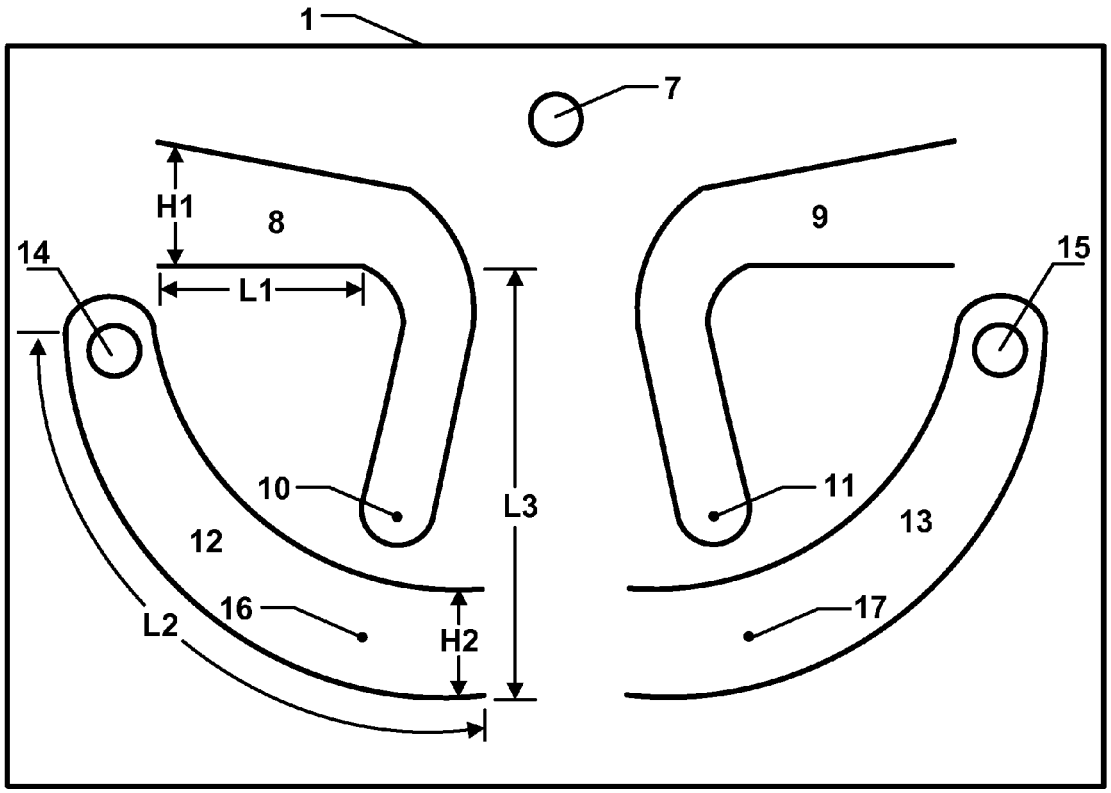
FIG. 3 is a rear elevational view of a flat stock substrate prior to extending the cutout arms and legs and inserting the flag mast in accordance with a disclosed embodiment.

FIG. 3 is a rear elevational view of a flat stock substrate prior to extending the cutout arms and legs and inserting the flag mast in accordance with a disclosed embodiment. The flat stock substrate includes two cutout arms 8 and 9 configured to extend from the flat stock substrate 1 and hang perpendicularly on a top rail 6 of the fence, the cutout arms 8 and 9 each configured at an elbow thereof to wrap around a top of the rail 6 and down over a side thereof. The web height of each cutout arm hangs perpendicularly on the fence rail surface for maximum strength against buckle, stress and strain. The device further includes two cutout legs 12 and 13 configured to extend from the flat stock substrate 1 in an upward arc perpendicular to the fence rail and join with the free end of the flag mast 4 through an end of each extended leg triangulated between the extended cutout arms. The point of insertion 7 for the flag mast 4 is proximal an upper edge of the substrate 1 and may also be diametrically positioned between side edges thereof. Each of the cutout arms 8, 9 and legs 12 and 13 may be one of marked, stamped, precut, and perforated for extending from the flat stock substrate by one of the owner and the manufacturer. The appendage components may be extended by twisting, pulling, pushing or any other action which separates a component from the substrate. An upper arm length L1 measured from the flat stock substrate 1 to the elbow thereof as depicted, exceeds a fence rail width of residential metal, wood and wrought iron fence rails and a lower edge thereof may be arcuate to accommodate arcuate railings. A length of each cutout leg L2 measured from the substrate to an end thereof is greater than a distance L3 from a bottom of a cutout arm to a bottom of a respective cutout leg. An upper arm web height H1 of each cutout arm is perpendicular to the top of the rail to provide a high bending load in a plane of the web and support the substrate, the printed display, the flag and the mast. An upper leg web height H2 of each cutout leg is perpendicular to the top of the rail to provide a high bending load in a plane of the upper leg web and support a torsional force of gravity on the mast free-end acting on the end of each leg joined thereto. The web heights H1 and H2 and respective heights for the second arm and second leg all form an I beam cross section at the substrate with the substrate providing the flanges thereof. Therefore, the arms extended over a fence railing have the perpendicular strength of an I beam web against buckling or bending forces of the loads thereon. A web height of each cutout leg and each cutout arm proximal the flat stock substrate is greater than a web height proximal an end thereof. An embodiment may further include securing an end of each twisted cutout arm at 10 or 11 to a respective portion of a respective twisted cutout leg at 16 or 17, the securing configured to lock in the substrate around the fence railing 6 for wind and weather resistance. Also, twisting each cutout leg end adjacent holes 14 and 15 by 180 degrees to be parallel with the flat stock substrate 1 and able to join with the mast free-end 4 locks in the substrate around the fence railing 6 for extra strength to removal therefrom.

In an embodiment of the disclosure, an inside angle of the elbow of each arm may be acute (less than 90 degrees) in order to provide maximum strength against the lower arm buckling or tearing from the upper arm adjacent the flat stock substrate 1. On the other hand, embodiments also include 90 degree elbow angles in order to maximize the length L1 for oversized fence railings not accommodated by an acute angle. Other differences in arm and leg placement, shape and substrate thickness are included in embodiments of the disclosure where various stresses and strains are dominating over others.

Figure 4:
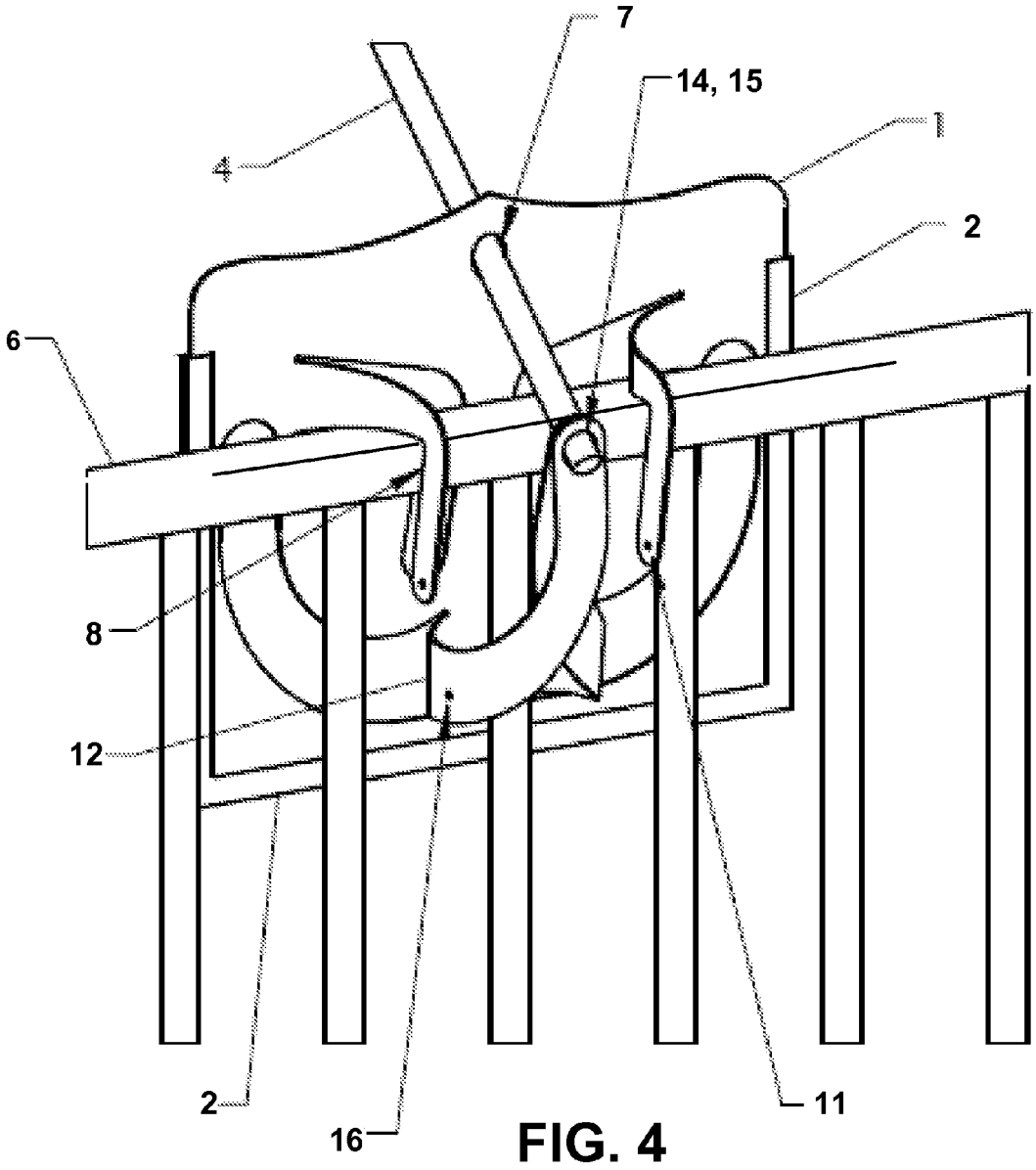
FIG. 4 is a rear perspective view of a flag mast and a flat stock substrate including extended arms and legs hung around a fence rail in accordance with a disclosed embodiment.

FIG. 4 is a rear perspective view of a flag mast and a flat stock substrate including extended arms and legs hung around a fence rail in accordance with a disclosed embodiment. Reference numbers used in FIG. 4 are the same and or similar to reference numbers used in FIG. 3 and throughout the present disclosure. The disclosed device includes two cutout arms 8 and 9 configured to extend from the flat stock substrate 1 and hang perpendicularly on a top rail of the fence 6, the cutout arms 8 and 9 each configured at an elbow thereof to wrap around a top of the rail 6 and down over a side thereof. The device additionally includes two cutout legs 12 and 13 configured to extend from the flat stock substrate 1 in an upward arc perpendicular to the fence rail and join with a free end of the flag mast 4 through an end 14 and 15 of each extended leg 12 and 13 triangulated between the extended cutout arms 8 and 9. The system further includes a flag 5 attached to a mast 4 at a first end thereof and a second end of the mast comprising the free-end, the flag mast 4 configured to be inserted through the flat stock substrate 1 over the fence rail 6 and into the extended cutout leg ends 14 and 15.

Figure 5:
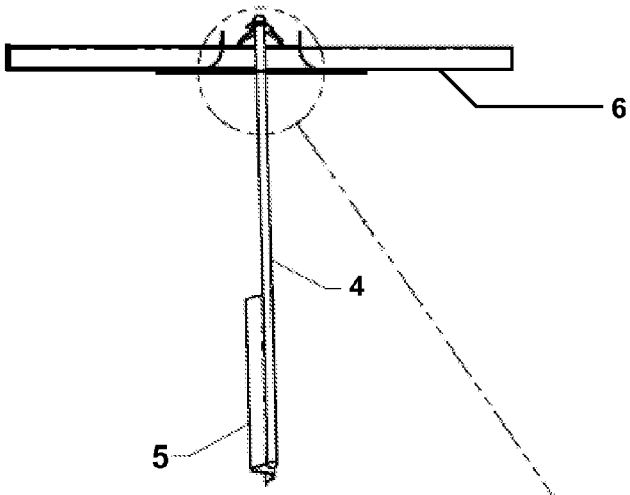
FIG. 5 is a top elevational view of an assembled system configured to attach a printed display and a flag therewith to a fence, rail or barrier and the like in accordance with a disclosed embodiment.

FIG. 5 is a top elevational view of an assembled system configured to attach a printed display and a flag therewith to a fence, rail or barrier and the like in accordance with a disclosed embodiment. The depiction illustrates two areas for close-up views further below.

Figure 6:
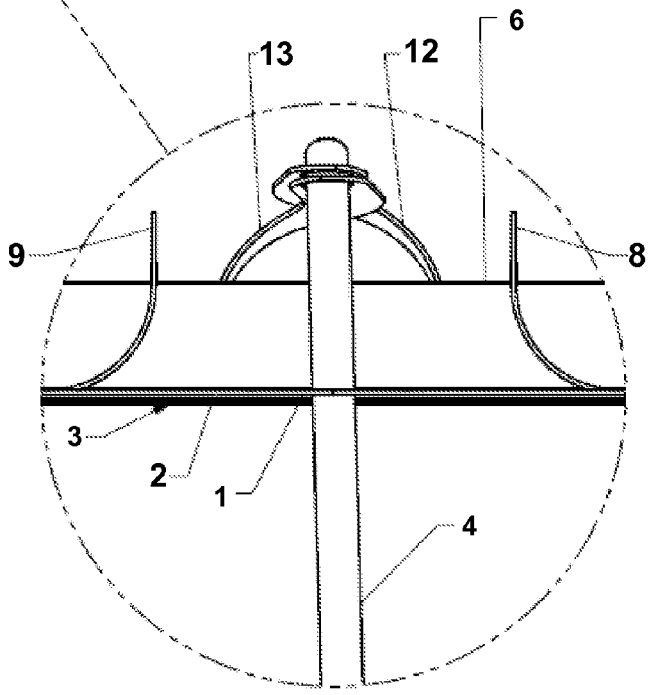
FIG. 6 is a close-up elevational view of the extended arms and legs of the flat stock substrate hung around a fence rail in accordance with a disclosed embodiment.

FIG. 6 is a close-up elevational view of the extended arms and legs of the flat stock substrate hung around a fence rail in accordance with a disclosed embodiment. An angle of incidence of each upper web of arms 8 and 9 on a top of the rail 6 is non-orthogonal to the substrate 1 or edges of the rail 6. Contact of each upper arm thereon is also angular with respect to the sides of the rail 6 to provide a maximum contact length of the upper arm web (H1) to the top of the rail 6 to support a weight of the substrate 1, the printed display 3, the flag 5 and the mast 4. The legs 12 and 13 are shown connected to the mast 4 end via respective holes 14 and 15. Thus the mast 4 creates a torque moment from the end of the mast 4 about the railing 6 to the other end of the mast at the flag 5 end. The legs 12 and 13 keep this torque moment in static equilibrium with gravity pulling down on the flag end of the mast. Therefore, the arcuate shape of the legs 12 and 13 help to maximize the strength of the flat stock substrate along the length of each leg 12 and 13. The legs 12 and 13 also provide some lateral movement resistance at the end of the mast 4. Together with the point of insertion hole 7, the legs and the insertion hole 7 secure the mast and flag against lateral wind influence.

Figure 7:
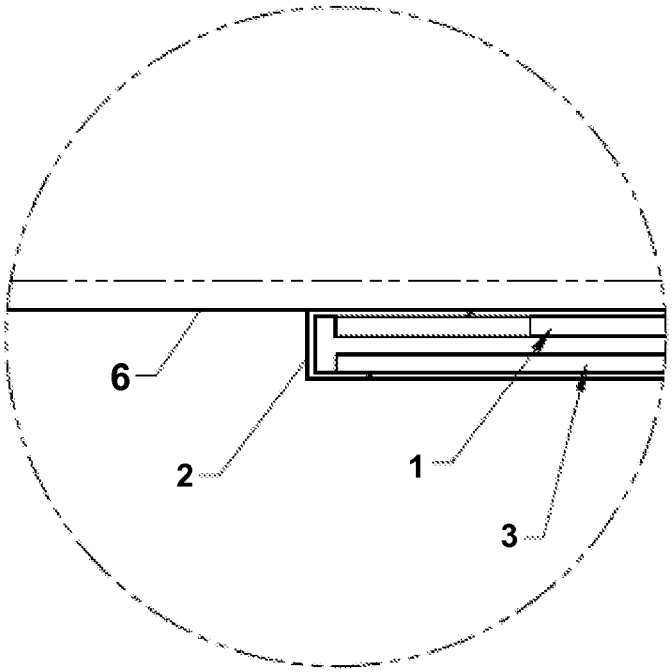
FIG. 7 is a close-up elevational view of a flat stock substrate and a printed display within an attached channel adjacent the fence rail in accordance with a disclosed embodiment.

FIG. 7 is a close-up elevational view of a flat stock substrate and a printed display within an attached channel adjacent the fence rail in accordance with a disclosed embodiment. Edges of the flat stock substrate 1 and the printed display 3 are shown received into the channel 2. The channel may be attached to the flat stock substrate 2 so the printed display can be removed and replaced with alternate messages or graphics. The channel 2 is depicted adjacent the fence rail 6 and also is adjacent with the fence balustrade, slats or dowels but is not necessarily connected or affixed thereto. Other components such as a clear front cover and a spacer between the flat stock substrate 1 and the printed display 3 may also be included in the disclosure as necessary to provide support, rigidity and weather protection to the device and system.

Figure 8:
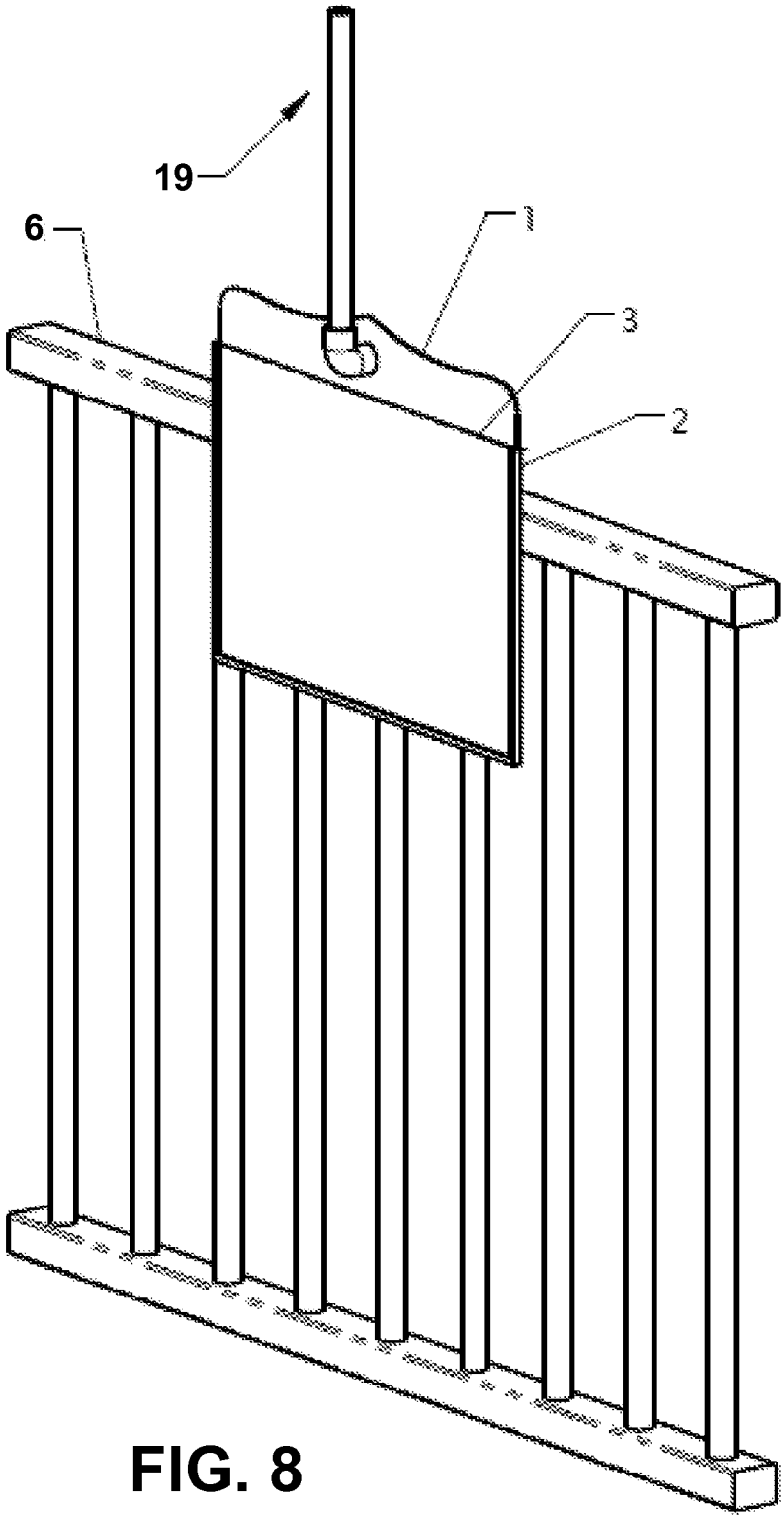
FIG. 8 is a front-side perspective view of an assembled system configured to attach a printed display and a flag therewith via a 90 degree adapter to a fence, rail or barrier and the like in accordance with a disclosed embodiment.

FIG. 8 is a front-side perspective view of an assembled system configured to attach a printed display and a flag therewith via a 90 degree adapter to a fence, rail or barrier and the like in accordance with a disclosed embodiment. A 90 degree angle component 19 may be attached at a first end to a front side of the flat stock substrate 1, a second free-end of the angle component 19 oriented upward and a pipe length attached thereto may be configured to receive a flag to mast or a rigid supporting member for a decoration. The angle component and the pipe length components may be comprised of PVC piping and any other rigid piping material. The system thus configured may allow greater visibility of the printed display apart from the flag attached thereto. The depicted system may also allow various decorations to be attached to the printed display via the 90 degree adapter to celebrate holidays and other significant events. The printed display may therefore include a holiday greeting and may also include photographs of family, friends and events.

Figure 9:
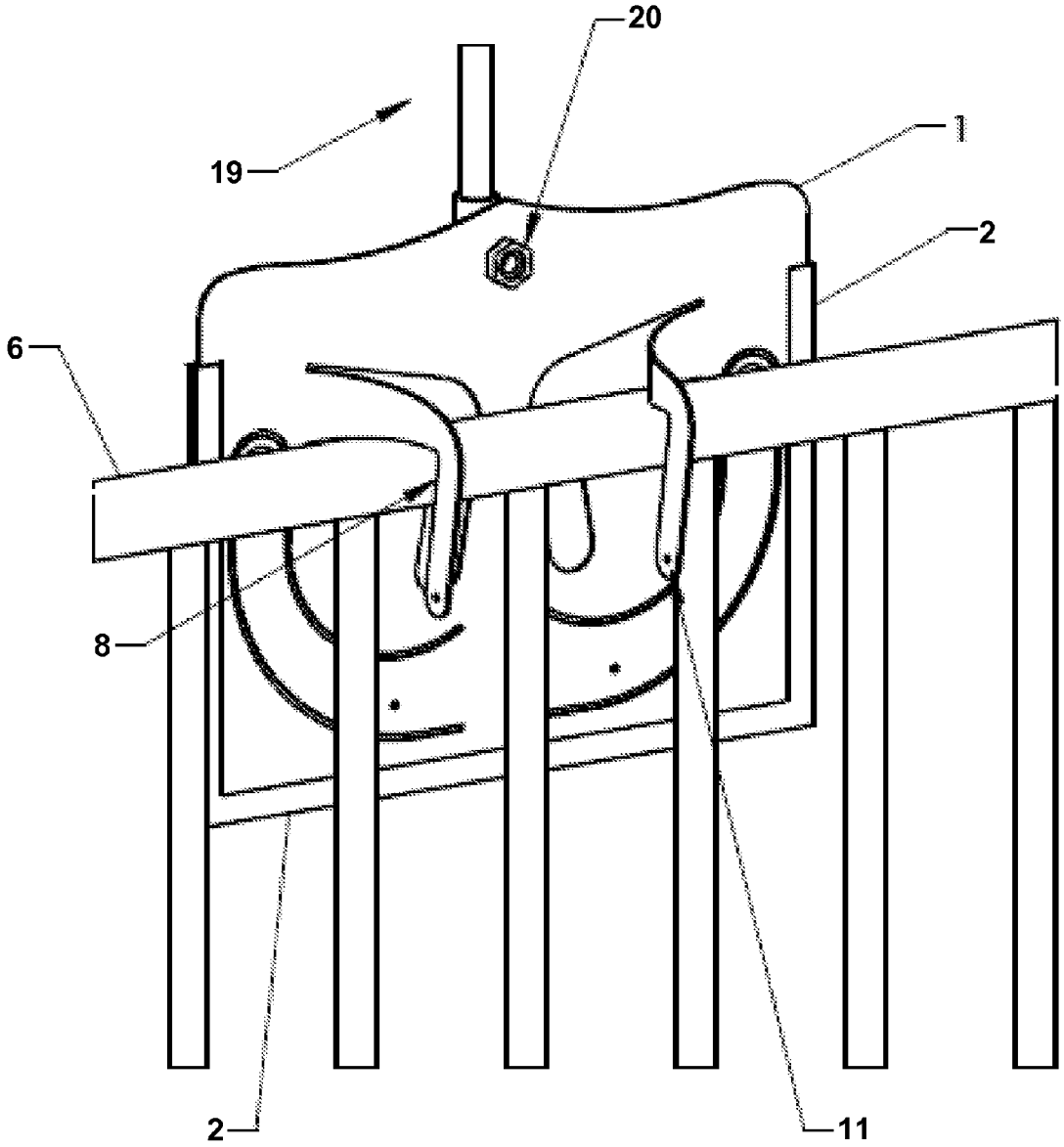
FIG. 9 is a back-side perspective view of an assembled system configured to attach a printed display and a flag therewith via a 90 degree adapter to a fence, rail or barrier and the like in accordance with a disclosed embodiment.

FIG. 9 is a back-side perspective view of an assembled system configured to attach a printed display and a flag therewith via a 90 degree adapter to a fence, rail or barrier and the like in accordance with a disclosed embodiment. Reference numbers used in FIG. 9 are the same and or similar to reference numbers used in FIGS. 3 and 4 and throughout the present disclosure. The nut 20 and optional washer and grommet (not depicted) may secure the angle adapter to the flat stock substrate 1. Though the legs 8 and 9 are not extended to receive an end of the flag mast 4, the legs may remain in the flat stock substrate or may nonetheless be twisted and triangulated together between the arms 8 and 9 thus providing protection against torsional movement around the fence railing 6.

Figure 10:
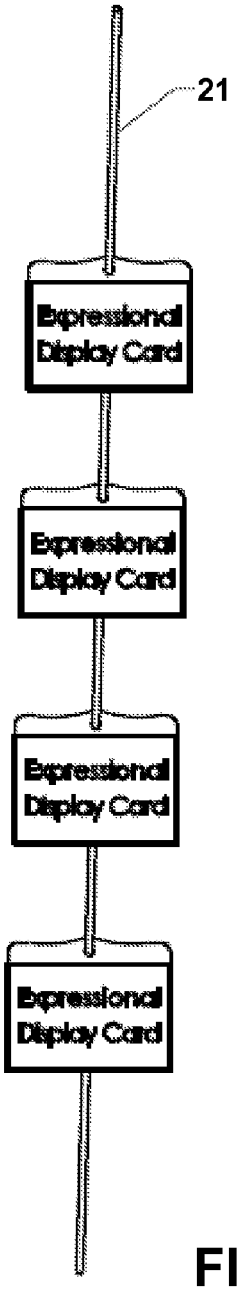
FIG. 10 is a front elevational view of multiple devices configured to attach a printed display and a flag therewith to a fence, rail or barrier and the like in accordance with a disclosed embodiment.

FIG. 10 is a front elevational view of multiple devices configured to attach a printed display and a flag therewith to a fence, rail or barrier and the like in accordance with a disclosed embodiment. Multiple substrates may be attached in series, aka 'ganged' on a single long mast 21. The ganged configuration is possible because of the two point attachment of the disclosed device to the mast 21 at both the point of insertion 7 and the holes 14 and 15 in the extended and twisted legs 12 and 13. Also, because of the torsional angle of insertion of the mast 21 through the flat stock substrate 1 and the torsional mechanical connection of the legs to the mast 21, each device stays anchored to the mast 21 in its respective position. Multiple devices thus configured may present a repetitive message or a message in parts to a consumer or to a voter or to any casual observer.

Figure 11:
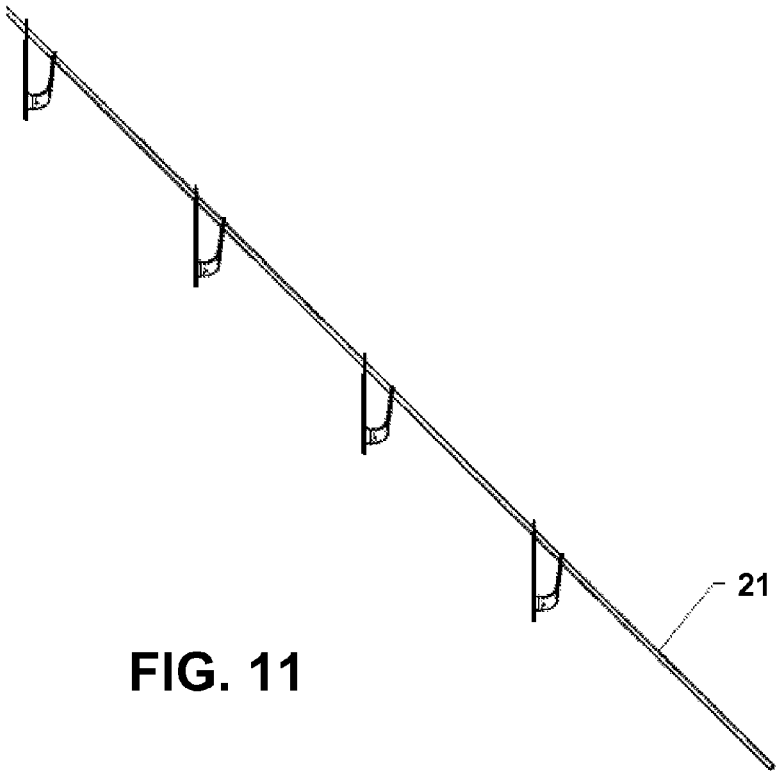
FIG. 11 is a side elevational view multiple devices configured to attach a printed display and a flag therewith to a fence, rail or barrier and the like in accordance with a disclosed embodiment.

FIG. 11 is a side elevational view multiple devices configured to attach a printed display and a flag therewith to a fence, rail or barrier and the like in accordance with a disclosed embodiment. As explained above, the mast 21 extends through the flat stock substrate 1 at an obtuse angle and thus forms a torsional mechanical attachment thereto. However, the flat stock substrate 1 may hang vertical to the forces of gravity or may be permanently tilted according to the circumstances and surroundings of the display and the device. A flag may or may not be included at either end of the long mast 21. The disclosed device thus attached to the long mast 21 may or may not be hung on a railing at either end according to the circumstances and environment of the display and the device.

Figure 12:
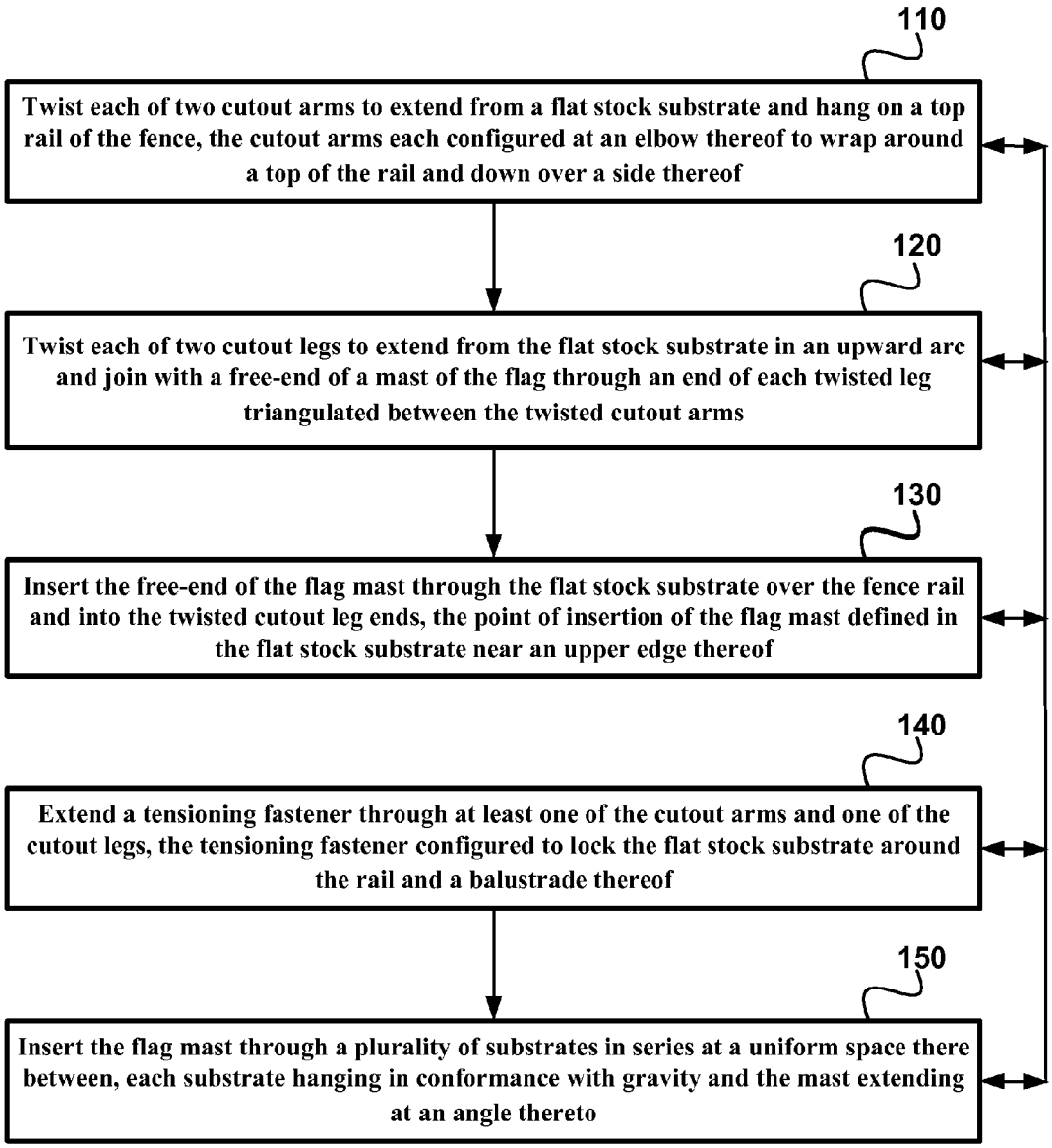
FIG. 12 is a flow chart of a method for attaching a printed display and a flag therewith to a fence, rail or barrier and the like in accordance with a disclosed embodiment.

FIG. 12 is a flow chart of a method for attaching a printed display and a flag therewith to a fence, rail or barrier and the like in accordance with a disclosed embodiment. The method includes twisting 110 each of two cutout arms to extend from a flat stock substrate and hang perpendicularly on a top rail of the fence, the cutout arms each configured at an elbow thereof to wrap around a top of the rail and down over a side thereof. The method also includes twisting 120 each of two cutout legs to extend from the flat stock substrate in an upward arc perpendicular to the fence rail and join with a free-end of a mast of the flag through an end of each twisted leg triangulated between the twisted cutout arms. The method further includes inserting 130 the free-end of the flag mast through the flat stock substrate over the fence rail and into the twisted cutout leg ends, the point of insertion of the flag mast defined in the flat stock substrate near an upper edge thereof.

Embodiments of the disclosed method may also include extending 140 an optional tensioning fastener through at least one of the cutout arms and one of the cutout legs, the tensioning fastener configured to lock the flat stock substrate around the rail and a balustrade thereof. Also, inserting 150 the flag mast through a plurality of substrates in series at a uniform space there between, each substrate hanging in conformance with gravity and the mast extending at an angle thereto may also be included in the disclosed method.

The disclosed device, system and method therefore satisfies the long felt for an integrated and monolithic flat stock system by producing the effective advertising benefits of three dimensional systems but having the production and installation costs of two dimensional signage systems. Furthermore, the disclosed device and system allow for serial signs to be rigidly placed on a long mast positioned either from the ground or from a railing without any additional fixtures or accessories.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A device configured to attach a printed display and a flag therewith to a fence, rail or barrier and the like, the device comprising:

a flat stock substrate defining a point of insertion for a free-end of a mast of the flag near an upper edge thereof in relation to viewing the display;

two cutout arms configured to extend from the flat stock substrate and hang perpendicularly on a portion of the fence or barrier, the cutout arms each configured at an elbow thereof to wrap around the fence or barrier portion and down over a side portion thereof; and at least one cutout leg configured to extend from the flat stock substrate in an upward arc perpendicular to the fence or barrier portion and join with the free end of the flag mast through an end of each extended leg between the extended cutout arms.

2. The device of claim 1, configured to attach a printed display and a flag therewith to a fence, rail or barrier and the like, further comprising two cutout legs configured to extend from the flat stock substrate in an upward arc perpendicular to a rail portion of the fence or barrier and join with the free end of the flag mast through an end of each extended leg triangulated between the extended cutout arms.

3. The device of claim 1, configured to attach a printed display and a flag therewith to a fence, rail or barrier and the like, further comprising ganging up a plurality of substrates in series on a single mast.

4. The device of claim 1, for attaching a printed display and a flag therewith to a fence, rail or barrier and the like, wherein an upper arm web height of each cutout arm forms an I beam cross section at the substrate and is perpendicular to a rail portion of the fence or barrier to provide a high bending load in a plane of the web and support the substrate, the printed display, the flag and the mast.

5. The device of claim 1, for attaching a printed display and a flag therewith to a fence, rail or barrier and the like, wherein an angle of incidence of each upper arm web on a rail portion of the fence or barrier and is non-orthogonal and contact thereon angular with respect to the sides of the rail to provide a maximum contact length of the upper arm web to the top of the rail to support the substrate, the printed display, the flag and the mast.

6. The device of claim 1, for attaching a printed display and a flag therewith to a fence, rail or barrier and the like, wherein an upper leg web height of each cutout leg forms an I beam cross section at the substrate and is perpendicular to a rail portion of the fence or barrier to provide a high bending load in a plane of the upper leg web and support a torsional force of gravity on the mast free-end acting on the end of each leg joined thereto.

7. The device of claim 1, for attaching a printed display and a flag therewith to a fence, rail or barrier and the like, wherein a length of the upper arm of each cutout arm measured from the flat stock substrate to the elbow thereof, exceeds a rail width portion of the fence or barrier of residential metal, wood and wrought iron fence rails.

8. The device of claim 1, configured to attach a printed display and a flag therewith to a fence, rail or barrier and the like, wherein a rigid channel is configured to receive the flat stock substrate and the printed display on a bottom and two sides thereof.

9. The device of claim 1, for attaching a printed display and a flag therewith to a fence, rail or barrier and the like, wherein a length of each cutout leg measured from the substrate to an end thereof is greater than a distance from a bottom of a cutout arm to a bottom of a respective cutout leg.

10. The device of claim 1, for attaching a printed display and a flag therewith to a fence, rail or barrier and the like, wherein the portion of the fence or barrier comprises one of a top, bottom and side rail, a horizontal member and any angular member with respect to a fence post and barrier column thereof, the members comprising chain link fence wires, pipes, wooden and plastic slats and concrete and plaster balustrades, posts and side panels.

11. The device of claim 1, for attaching a printed display and a flag therewith to a fence, rail or barrier and the like, wherein the flat stock substrate comprises a resilient low durometer material suitable for bending without folding, creasing, tearing or ripping.

12. A system configured to attach a printed display and a flag therewith to a fence, rail or barrier and the like, the device comprising:

a resilient low durometer flat stock substrate defining a point of insertion for a free-end of a mast of the flag near an upper edge thereof in relation to viewing the display;

two cutout arms configured to extend from the flat stock substrate and hang perpendicularly on a top rail of the fence, the cutout arms each configured at an elbow thereof to wrap around a top of the rail and down over a side thereof;

two cutout legs configured to extend from the flat stock substrate in an upward arc perpendicular to the fence rail and join with a free end of the flag mast through an end of each extended leg triangulated between the extended cutout arms; and a decoration attached to a rigid member at a first end thereof and a second end of the rigid member comprising the free-end, the rigid member configured to be inserted through the flat stock substrate over the fence rail and into the extended cutout leg ends.

13. The system of claim 12, configured to attach a printed display and a flag therewith to a fence, rail or barrier and the like, wherein each of the cutout arms and legs are one of marked, stamped, precut, and perforated for extending from the flat stock substrate by one of the owner and the manufacturer.

14. The system of claim 12, configured to attach a printed display and a flag therewith to a fence, rail or barrier and the like, further comprising a 90 degree angle piece attached to a front side of the flat stock substrate, a free-end of the angle piece oriented upward and a pipe length attached thereto at the free-end configured to receive one of a flag mast and a rigid member of a decoration.

15. A method for attaching a printed display and a flag therewith to a fence, rail or barrier and the like, the method comprising:

twisting each of two cutout arms to extend from a flat stock substrate and hang perpendicularly on a top rail of the fence, the cutout arms each configured at an elbow thereof to wrap around a top of the rail and down over a side thereof;

twisting each of two cutout legs to extend from the flat stock substrate in an upward arc perpendicular to the fence rail and join with a free-end of a mast of the flag through an end of each twisted leg triangulated between the twisted cutout arms; and inserting the free-end of the flag mast through the flat stock substrate over the fence rail and into the twisted cutout leg ends, the point of insertion of the flag mast defined in the flat stock substrate near an upper edge thereof.

16. The method of claim 15, for attaching a printed display and a flag therewith to a fence, rail or barrier and the like, further comprising securing an end of each twisted cutout arm to a portion of a respective twisted cutout leg, the securing configured to lock in the substrate around the fence railing for wind and weather resistance.

17. The method of claim 15, for attaching a printed display and a flag therewith to a fence, rail or barrier and the like, further comprising twisting each cutout leg end 180 degrees to be parallel with the flat stock substrate and able to join with the mast free-end.

18. The method of claim 15, for attaching a printed display and a flag therewith to a fence, rail or barrier and the like, further comprising securing a printed display to the flat stock via a channel attached thereto configured to receive a bottom and two sides of the flat stock and the printed display.

19. The method of claim 15, for attaching a printed display and a flag therewith to a fence, rail or barrier and the like, further comprising extending an optional tensioning fastener through at least one of the cutout arms and one of the cutout legs, the tensioning fastener configured to lock the flat stock substrate around the rail and a balustrade thereof.

20. The method of claim 15, for attaching a printed display and a flag therewith to a fence, rail or barrier and the like, further comprising inserting the flag mast through a plurality of substrates in series at a uniform space there between, each substrate hanging in conformance with gravity and the mast extending at an angle thereto.

* * * * *